US011512503B2

(12) United States Patent
Nishizuka

(10) Patent No.: US 11,512,503 B2
(45) Date of Patent: Nov. 29, 2022

(54) INSIDE HANDLE DEVICE

(71) Applicant: ALPHA CORPORATION, Kanagawa (JP)

(72) Inventor: Mitsuo Nishizuka, Yokohama (JP)

(73) Assignee: ALPHA CORPORATION, Kanagawa (JP)

( * ) Notice: Subject to any disclaimer, the term of this patent is extended or adjusted under 35 U.S.C. 154(b) by 131 days.

(21) Appl. No.: 16/937,687

(22) Filed: Jul. 24, 2020

(65) Prior Publication Data

US 2020/0354994 A1 Nov. 12, 2020

Related U.S. Application Data

(63) Continuation of application No. PCT/JP2019/003528, filed on Jan. 31, 2019.

(30) Foreign Application Priority Data

Jan. 31, 2018 (JP) ..... JP2018-014547

(51) Int. Cl.
*E05B 79/06* (2014.01)
*E05B 79/20* (2014.01)
(Continued)

(52) U.S. Cl.
CPC ..... *E05B 79/06* (2013.01); *E05B 79/20* (2013.01); *E05B 79/22* (2013.01); *E05B 85/12* (2013.01)

(58) Field of Classification Search
CPC ..... E05B 79/06; E05B 79/20; E05B 79/22; E05B 85/12; E05B 77/00
See application file for complete search history.

(56) References Cited

U.S. PATENT DOCUMENTS 8,616,611 B2 12/2013 Schidan et al.
10,119,307 B2 * 11/2018 Sugimoto ..... E05B 79/08
2017/0037663 A1 2/2017 Sugimoto

FOREIGN PATENT DOCUMENTS

FR 2876077 A1 4/2006
JP 2009287333 A 12/2009
(Continued)

OTHER PUBLICATIONS

The extended European search report issued by the European Patent Office dated Oct. 14, 2021, which corresponds to European Patent Application No. 19746882.0-1005 and is related to U.S. Appl. No. 16/937,687.

(Continued)

*Primary Examiner* — Kristina R Fulton
*Assistant Examiner* — Thomas L Neubauer
(74) *Attorney, Agent, or Firm* — Studebaker & Brackett PC

(57) ABSTRACT

An inside handle device of a vehicle includes a handle base and a cable holding case. The inside handle device is connected to a door latch device fixed to a door via a cable device in which an inner cable is inserted into an outer cable, and is configured to remotely control the door latch device. The handle base is configured to swingably support a handle body. The handle body includes an operation portion capable of being operated from a front surface at one end portion and a cable connection recessed portion opening to a back surface direction at another end portion. The cable holding case includes a cable fixing portion configured to fix one end of the outer cable.

4 Claims, 8 Drawing Sheets

(51) Int. Cl.
*E05B 79/22* (2014.01)
*E05B 85/12* (2014.01)

(56) References Cited

FOREIGN PATENT DOCUMENTS

| | | | |
|---|---|---|---|
| JP | 2012097476 | A | 5/2012 |
| JP | 2015206234 | A | 11/2015 |

OTHER PUBLICATIONS

International Preliminary Report on Patentability and Written Opinion issued in PCT/JP2019/003528; dated Aug. 4, 2020.
International Search Report issued in PCT/JP2019/003528; dated Feb. 26, 2019.

* cited by examiner

INSIDE HANDLE DEVICE

CROSS REFERENCE TO RELATED APPLICATIONS

This application is a continuation of PCT application No. PCT/JP2019/003528, which was filed on Jan. 31, 2019 based on Japanese Patent Application No. 2018-014547 filed on Jan. 31, 2018, the contents of which are incorporated herein by reference.

BACKGROUND OF THE INVENTION

Field of the Invention

The present invention relates to an inside handle device.

Description of Related Art

A device disclosed in Patent Literature 1 is known as an inside handle device mounted on an indoor side wall surface of a vehicle door.

In a related-art example, the inside handle device is formed by rotatably connecting a lock knob and an inner door handle to a handle base, and the other end of a cable whose one end is connected to a latch mechanism is connected to the inner door handle.

The inner door handle and the cable are connected by fitting a spherical end portion formed at a tip end of the cable (inner cable) into an engagement hole formed in the inner door handle.

[Patent Literature 1] JP-A-2012-97476

In the above-described related-art example, the work of engaging the end portion of the inner cable with the engagement hole of the inner door handle is troublesome.

SUMMARY

One or more embodiments provide an inside handle device of a vehicle in which a connecting operation of a cable device is easy.

In an aspect (1), an inside handle device of a vehicle includes a handle base and a cable holding case. The inside handle device is connected to a door latch device fixed to a door via a cable device in which an inner cable is inserted into an outer cable, and is configured to remotely control the door latch device. The handle base is configured to swingably support a handle body. The handle body includes an operation portion capable of being operated from a front surface at one end portion and a cable connection recessed portion opening to a back surface direction at another end portion. The cable holding case includes a cable fixing portion configured to fix one end of the outer cable. The cable holding case is configured to hold a handle connecting portion formed at one end of the inner cable and capable of being connected to the handle base, and configured to lock the handle connecting portion in a connected state to a cable connection recessed portion of the handle body. The cable holding case is capable of releasing the connection with the handle base by a connection release force in the back surface direction obtained by converting a direction of a load applied to the cable fixing portion in a pulling direction by the outer cable.

According the aspect (1), the inside handle device includes the handle base 8 rotatably connected to the handle body 7 and the cable holding case 11 to which the outer cable 1 of the cable device 3 is fixed on the cable fixing portion 9.

By connecting the cable holding case 11 to the handle base 8 by an appropriate connecting means, the handle connecting portion 10 of the inner cable 2 held by the cable holding case 11 is locked in the cable connection recessed portion 6 of the handle body 7, and thereafter an rotating operation force applied to the handle body 7 is transmitted to the door latch device 4 via the inner cable 2.

Therefore, the handle connecting portion 10 of the inner cable 2 can be connected to the handle body 7 only by connecting the cable holding case 11 to the handle base 8. Since the work of guiding the handle connecting portion 10 to an engagement hole of the handle body 7 and fitting the handle connecting portion 10 as the work in a related-art example is unnecessary, connecting workability is improved.

Further, when a relative position between the inside handle device and the door latch device 4 changes in a direction away from an initial setting due to a collision and the like, a force in the pulling direction is applied to the cable fixing portion 9 of the cable holding case 11 by the outer cable 1.

The cable holding case 11 is moved in an unlocking direction with the cable connecting concave portion 6 of the handle connecting portion 10 by the load applied to the cable fixing portion 9 and is detached from the handle base 8, and thereafter, the cable holding case 11 to which the cable device 3 is fixed moves following the door latch device 4.

Therefore, if the distance between the door latch device 4 and the handle unit becomes unexpectedly large while the inner cable 2 is permanently attached to the handle body 7 as in the related-art example, the handle connecting portion 10 of the inner cable 2 moves in a direction away from the door latch device 4 together with the handle unit and a latch release operation of the door latch device 4 may be performed. However, in the present invention, since the cable device 3 moves following the door latch device 4 after the cable holding case 11 is detached from the handle base 8, the door latch device 4 is not operated and a careless door opening operation can be reliably prevented.

In an aspect (2), the cable holding case may include a riding portion which rides over a riding protrusion of the handle base and move the cable holding case in a connection release direction as the cable fixing portion moves in the pulling direction.

In an aspect (3), the cable holding case may be locked to the handle base at a peripheral portion where the cable fixing portion is formed. An opposite edge portion may be resiliently locked to the handle base on a rotation locus with a locking portion with the handle base as a rotation center and is connected to the handle base.

Although a connection operation of connecting the cable holding case 11 to the handle base 8 is easy compared with a fitting operation after the handle connecting portion 10 formed at a tip end of the inner cable 2 is guided into a connection hole of the handle body 7 no matter what kind of means is used, according to this aspect, since the cable holding case 11 can be connected to the handle base 8 only by rotating around the locking portion after one end portion of the cable holding case 11 is locked, the connection workability is further improved.

In an aspect (4), the cable holding case is provided with a hook-shaped resilient locking piece which resiliently locks to a locking protrusion protruding from the handle base. A locking surface between the locking protrusion and the resilient locking piece is formed by an inclined surface which generates an operation force in an unlocking direction on the elastic locking piece by a load applied to the cable holding case in the connection release direction.

According to the aspect (4), when the load in the cable pulling direction is applied to the cable holding case 11, combined with an action of an operation force direction conversion mechanism, the locking surface of the resilient locking piece 15 moves so as to slide down along the inclined surface of the locking protrusion 14, and thus a locked state between the locking protrusion 14 and the resilient locking piece 15 is released nondestructively.

In an aspect (5), an elastic deformation leg which extends in a direction substantially orthogonal to a cable pulling direction from the cable fixing portion may protrude from one of the cable holding case and the handle base. The other of the cable holding case and the handle base may be provided with an interference protrusion which abuts on a free end portion of the elastic deformation leg and restricts movement of the cable holding case in the cable pulling direction.

According to the aspect (5), when the force in the cable pulling direction is applied, since the leg portion restricts the movement in the cable pulling direction, when the unlocking operation of the resilient locking piece 15 is regulated and the load reaches a predetermined magnitude and the leg portion is elastically deformed, the force in the unlocking direction is generated in the resilient locking piece 15.

As a result, by adjusting the elastic deformability of the leg portion, it is possible to accurately adjust a detaching force of the resilient locking piece 15, that is, a detaching force of the cable holding case 11, and it is possible to reliably prevent accidental detachment of the cable holding case 11.

BRIEF DESCRIPTION OF THE DRAWINGS

FIG. 3A is a view as viewed from the front surface side. FIG. 3B is a cross-sectional view taken along a line 3B-3B in FIG. 3A.

FIG. 6A is a view viewed in a direction of an arrow 6A in FIG. 5. FIG. 6B is a cross-sectional view taken along a line 6B-6B in FIG. 5. FIG. 6C is a cross-sectional view taken along a line 6C-6C in FIG. 5.

DETAILED DESCRIPTION

Figure 1:
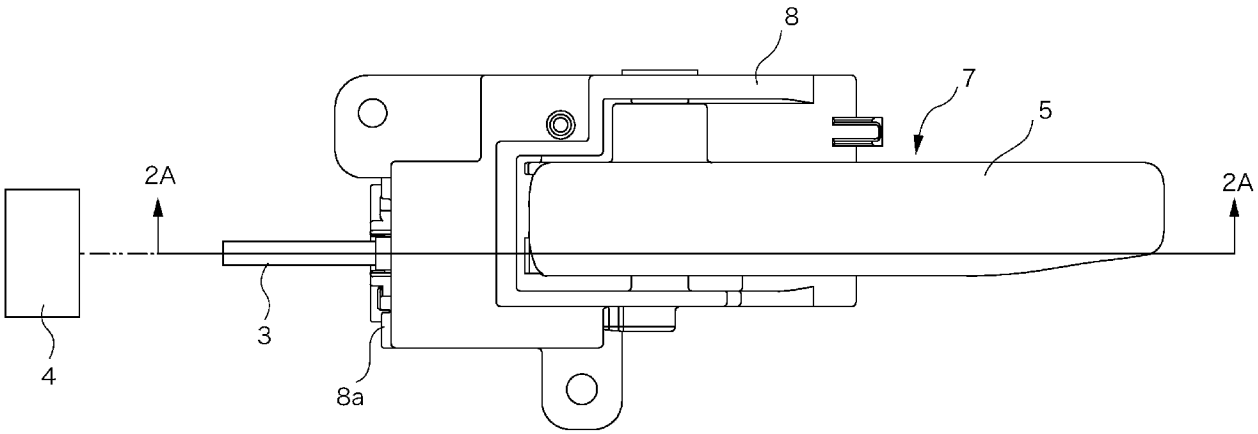
FIG. 1 is a view of an inside handle device as viewed from a front surface side.

As illustrated in FIG. 1 and below, an inside handle device includes a handle unit 18 in which a handle body 7 is connected to a handle base 8 and a cable unit 19 in which a cable device 3 is connected to a cable holding case 11. The handle base 8 is fixed to a door trim (not shown) fixed to an indoor side wall surface of a door and attached to the door.

Figure 2:
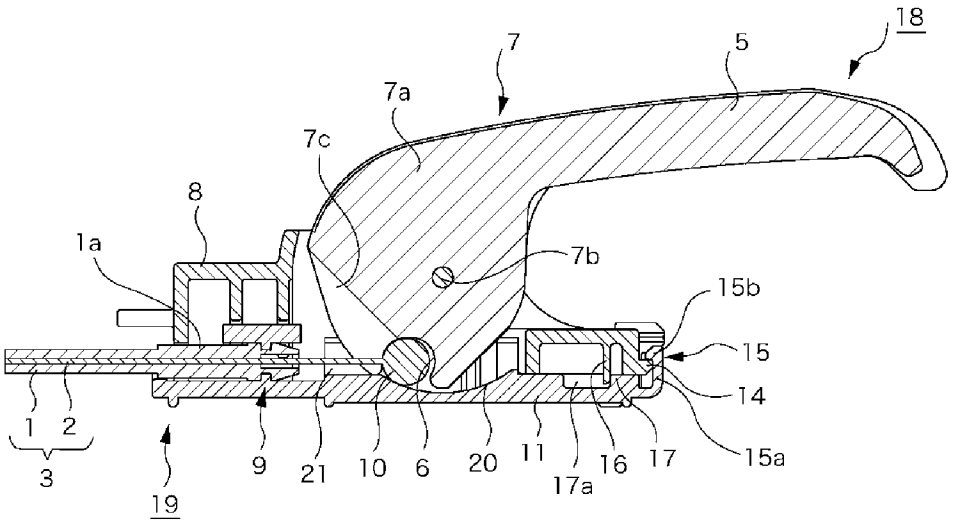
FIG. 2 is a cross-sectional view taken along a line 2A-2A in FIG. 1.
Figure 3A:
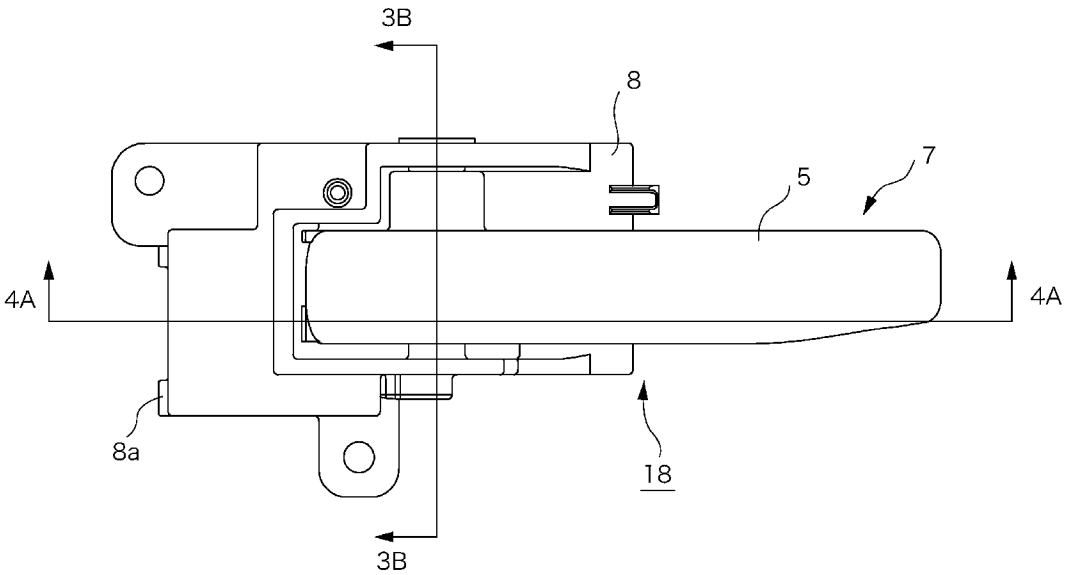
FIGS. 3A and 3B are views illustrating a handle unit.
Figure 3B:
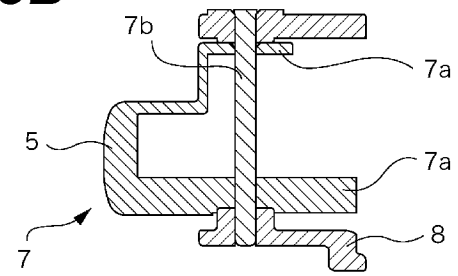

As illustrated in FIGS. 2 and 3A and 3B, the handle body 7 includes hinge pieces 7*a* protruding from upper and lower ends of one end of a lever-shaped operation portion 5 to a back surface side, and is rotatably connected to the handle base 8 via a rotating shaft 7*b* penetrating the hinge pieces 7*a*. A torsion spring (not shown) is mounted between the handle body 7 and the handle base 8 to urge the handle body 7 to an initial rotation position illustrated in FIG. 2.

In this description, an upper side is "front surface side", a lower side is "back surface side", a left side is "front", a right side in FIG. 2 is "rear", an upper side is "upper", and a lower side in FIG. 1 is "lower".

Further, a notch-shaped cable connection recessed portion 6 that is open toward a back surface direction is formed at a back surface side end portion of the hinge piece 7*a* disposed below. A ceiling surface of the cable connection recessed portion 6 has a spherical shape such that, as will be described later, a handle connecting portion 10 formed in a spherical shape of an inner cable 2 can be fitted to the cable connecting concave portion 6, and as illustrated in FIG. 2, a slit 7*c* for preventing interference with the inner cable 2 is formed in a central portion in a plate thickness direction (upper-lower direction).

Figure 4:
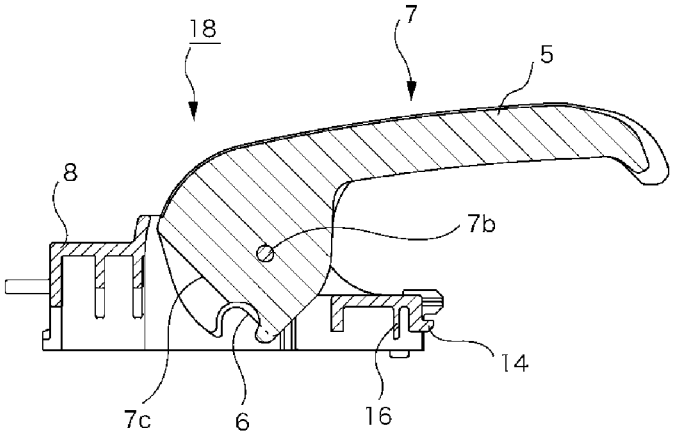
FIG. 4 is a cross-sectional view taken along a line 4A-4A in FIG. 3A.

Further, as illustrated in FIG. 4, the cable connection recessed portion 6 has a small diameter corresponding to a diameter of the handle connecting portion 10 which decreases in the upper-lower direction from a center, and the small-diameter portion of the cable connection recessed portion 6 abuts on a peripheral wall of the handle connecting portion 10 to efficiently transmit a displacement due to a rotation operation of the handle body 7 to the cable device 3.

On the other hand, as illustrated in FIGS. 1 and 2, the cable device 3 is formed by slidably inserting the inner cable 2 into an outer cable 1, one end thereof is connected to the door latch device 4 fixed to the door panel and the other end thereof is connected to the cable holding case 11. A connecting fitting 1*a* is fixed to an end portion of the outer cable 1, and the spherical handle connecting portion 10 is fixed to a tip end of the inner cable 2.

Figure 5:
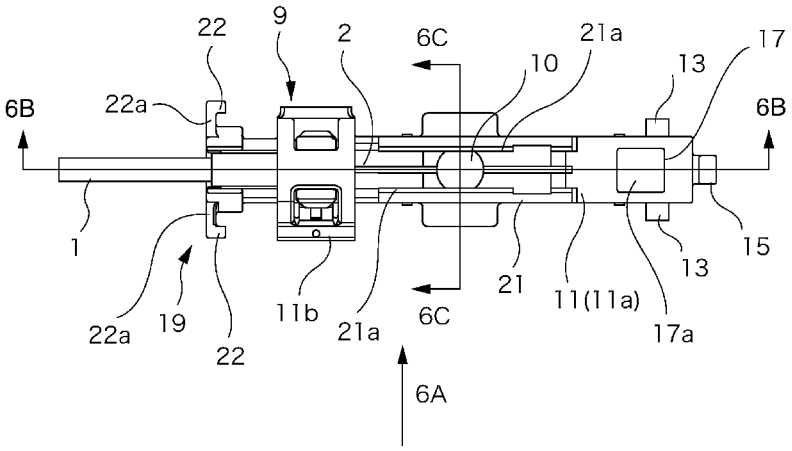
FIG. 5 is a diagram illustrating a cable unit.
Figure 6A:
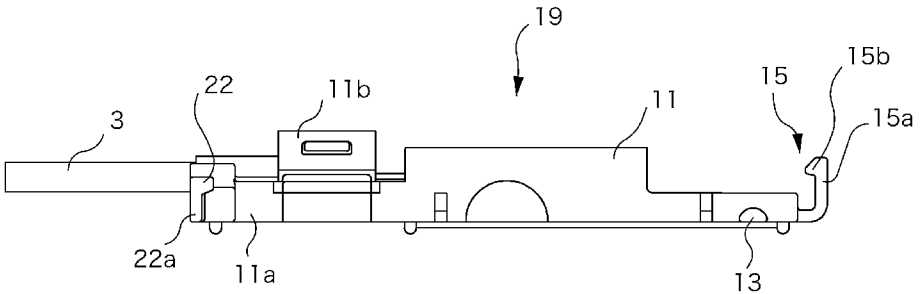
FIGS. 6A to 6C are views illustrating the cable unit.
Figure 6B:
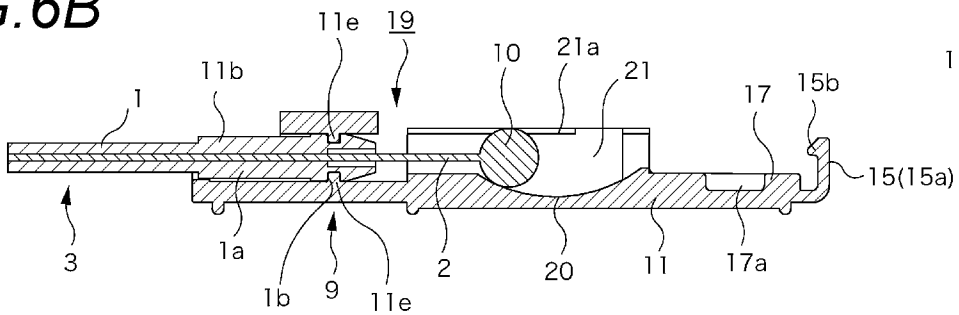
Figure 6C:
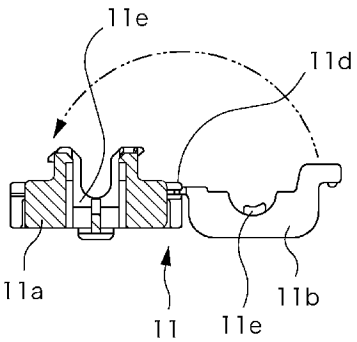

As illustrated in FIGS. 5 and 6A to 6C, the cable holding case 11 is formed by protruding a cover portion 11*b* from a side edge of a main body portion 11*a*, and as illustrated in FIG. 6C, a cover portion 11*c* can be resiliently locked to the main body portion 11*a* by bending the cover portion 11*c* in an arrow direction from a hinge portion 11*d* and overlapping the main body portion 11*a*.

The main body portion 11*a* and the cover portion 11*b* are provided with protrusions 11*e*, and as illustrated in FIG. 6B, when the cover portion 11*b* is superposed on the main body portion 11*a* with fitting grooves 1*b* formed in the connecting fitting 1*a* of the outer cable 1 fitted into the protrusions 11*e* of the main body portion 11*a*, the protrusions 11*e* of the cover 11*b* are fitted into the fitting grooves 1*b* of the connecting fitting 1*a*. In this state, the protrusions 11*e* are fitted into the fitting grooves 1*b* of the outer cable 1 from a front-back direction to form a cable fixing portion 9, and the outer cable 1, that is, the cable device 3, is restricted from being removed.

Further, a guide concave portion 20 guiding the handle connecting portion 10 of the cable device 3 that is connected to the cable holding case 11 as described above is formed in the main body portion 11*a*. As will be described later, the guide concave portion 20 is centered on the rotating shaft 7*b* of the handle body 7 in a state in which the cable holding case 11 is connected to the handle base 8, and is formed by an arc whose radius is a distance from the rotation shaft 7*b* to the handle connecting portion 10 (see FIG. 2), and eave-shaped stopper protrusions 21*a* that are opposed to each other protrude from tip ends of a pair of rising walls 21 that are arranged in the upper-lower direction so as to sandwich the guide concave portion 20.

Therefore, in this example, as illustrated in FIGS. 5 and 6A to 6C, since the stopper protrusions 21*a* restrict the detachment to the front surface side when the handle connecting portion 10 is on the guide concave portion 20, the handle connecting portion 10 is held in a predetermined position without being detached from the guide concave portion 20 even when the cable holding case 11 is not connected to the handle base 8.

In order to connect the cable holding case 11 formed as described above to the handle base 8, a locking hook 22 and a resilient locking piece 15 are provided on the cable holding case 11, and a locked protrusion 8*a* and a locking protrusion 14 are provided on the handle base 8.

As illustrated in FIG. 5, the locking hook 22 protrudes rearward from a tip end of a protruding piece 22*a* that protrudes from a front end portion of the cable holding case 11 in the upper-lower direction, and the locked protrusion 8*a* protrudes forward from a front end portion of the handle base 8 in correspondence with the locking hook 22.

Further, the resilient locking piece 15 is formed by protruding a hook-shaped locking portion 15*b* rearward from a tip end of an elastically deformable leg piece 15*a* that protrudes from a rear end of the cable holding case 11 to the front surface side, and the locking protrusion 14 on a handle base 8 side protrudes rearward so as to be lockable with the locking portion 15*b* of the resilient locking piece 15.

Figure 7:
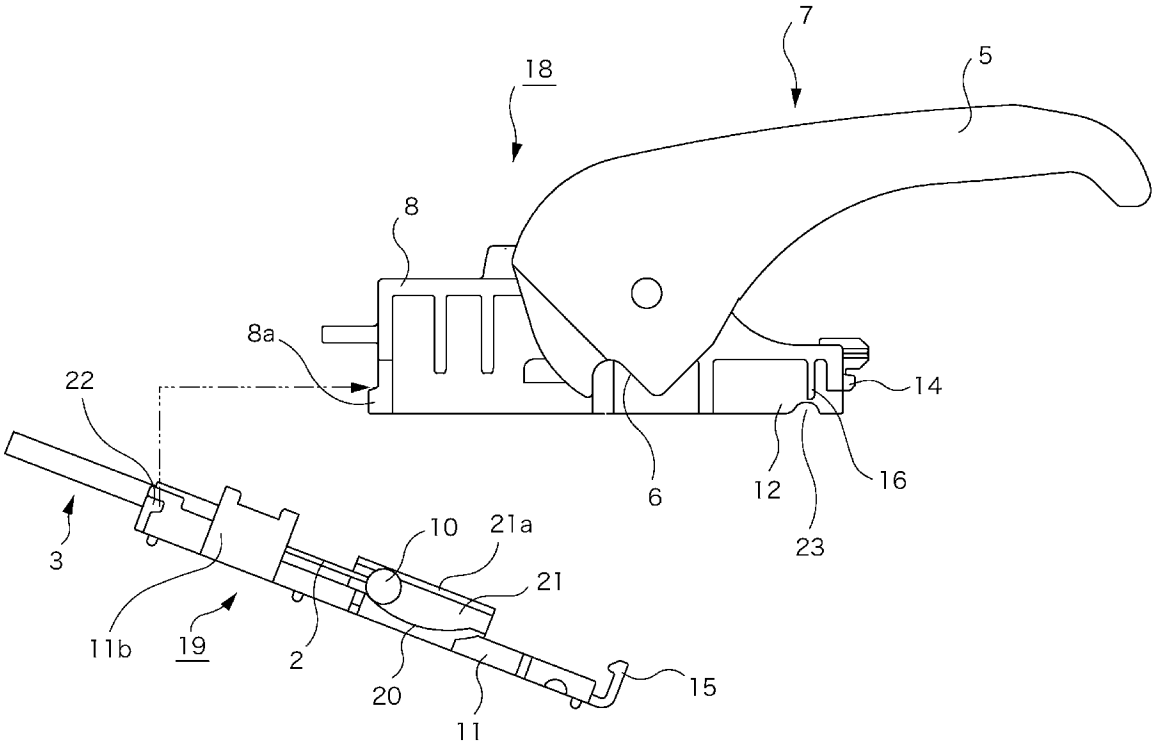
FIG. 7 is a diagram illustrating a connecting operation of the cable unit.
Figure 8:
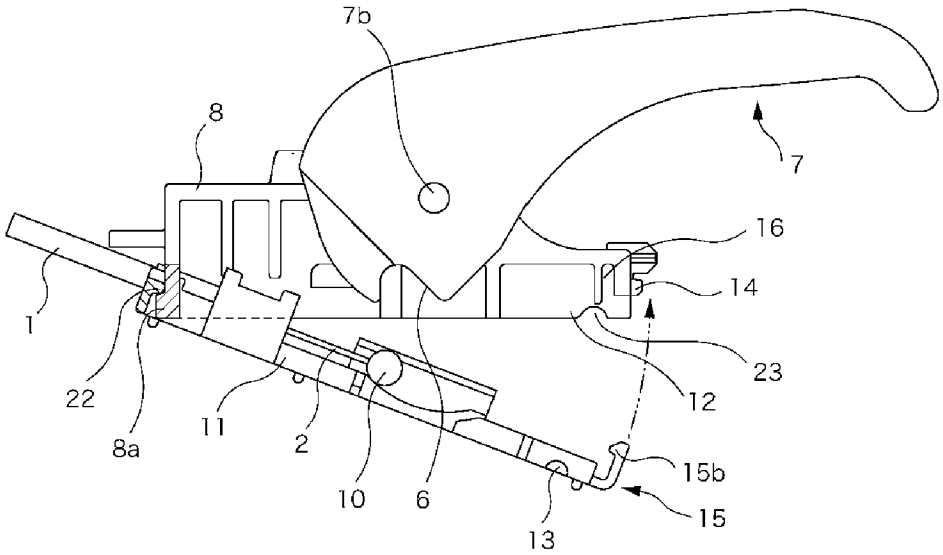
FIG. 8 is a diagram illustrating the connecting operation of the cable unit.

Therefore, in this example, as illustrated in FIGS. 7 and 8, first, when the locking hook 22 is locked to the locked protrusion 8*a* and then the entire cable holding case 11 is rotated around a locking portion counterclockwise (arrow direction) in FIG. 8, the locking portion 15*b* of the resilient locking piece 15 comes into contact with the locking protrusion 14 of the handle base 8.

When the cable holding case 11 is further pushed from this state, the leg piece 15*a* of the resilient locking piece 15 is elastically deformed once, and the locking portion 15*b* rides over the locking protrusion 14, and thereafter the resilient locking piece 15 is locked to the locking protrusion 14 as the leg piece 15*a* elastically returns. In the locked state, a rearward sliding operation of the cable holding case 11 with respect to the handle base 8 is restricted by interference between the locking hook 22 and the handle base 8, and a forward sliding operation, that is, a sliding operation in a direction in which the cable device 3 is pulled from the cable fixing portion 9 is restricted by interference between the leg piece 15*a* and the locking protrusion 14.

Further, when the cable holding case 11 is connected to the handle base 8, the movement of the cable holding case 11 in the back surface direction is restricted by the locking of the locking hook 22 with the locked protrusion 8*a* and the locking of the locking portion 15*b* with the locking protrusion 14, and since the movement in these directions is restricted, a connection state of the cable holding case 11 to the handle base 8 is maintained.

At the time of connecting the cable holding case 11 to the handle base 8, the handle body 7 is held in the initial rotation position as described above, and the handle connecting portion 10 of the inner cable 2 in a state of being fixed to the cable holding case 11 is determined by a state of the door latch device 4 connected to one end side thereof, and is held at a lock corresponding position as illustrated in FIG. 8. When the cable holding case 11 is connected to the handle base 8 from this state, the handle connecting portion 10 of the inner cable 2 is fitted into the cable connection recessed portion 6 of the handle body 7. Thereafter, an rotating operation force applied to the handle body 7 can be transmitted to the door latch device 4 via the cable device 3, and when the handle body 7 is rotated counterclockwise in FIG. 2 from the initial rotation position in the connected state, the inner cable 2 is pulled, and a latch release operation of the door latch device 4 can be performed.

As illustrated in FIGS. 5 and 8, a riding portion 13 protruding in the upper-lower direction is provided slightly forward than the resilient locking piece 15 and on a rear end portion of the cable holding case 11*a*, and the handle base 8 is provided with a recessed portion 23 into which the riding portion 13 is fitted in a state in which the cable holding case 11 is connected to the handle base 8.

Figure 9A:
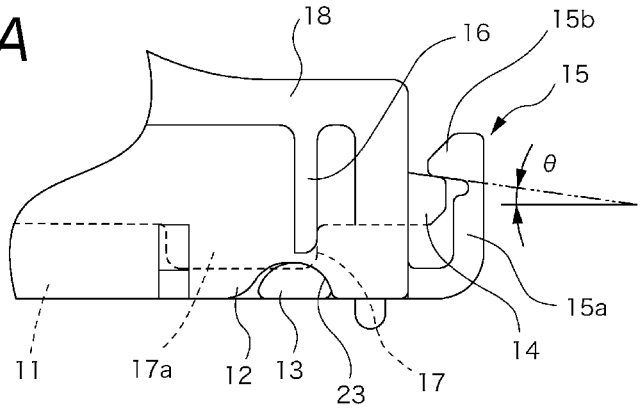
FIGS. 9A to 9C are illustrative views illustrating a detaching operation of the cable unit.
Figure 9B:
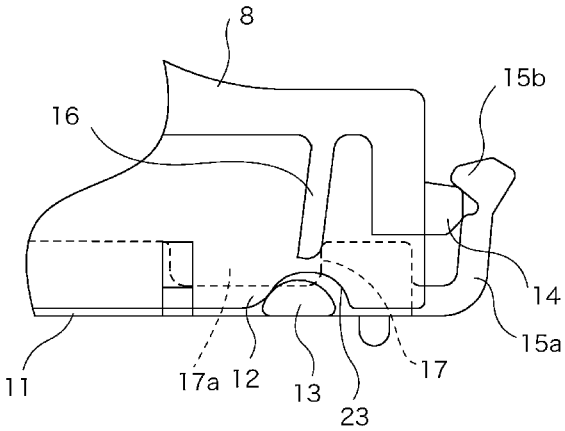
Figure 9C:
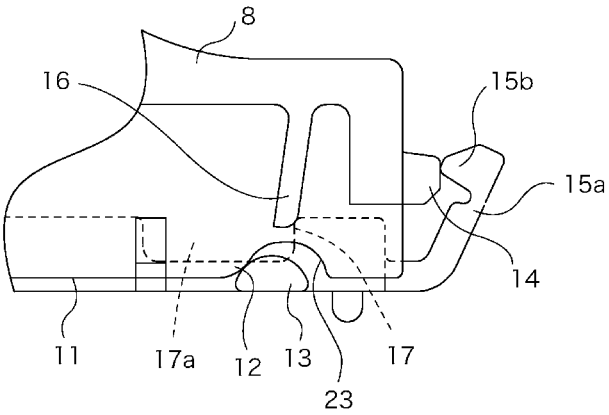

Further, as illustrated in FIGS. 9A to 9C, a locking surface of the locking portion 15*b* of the cable holding case 11 and the locking protrusion 14 of the handle base 8 is formed by an inclined surface (inclination angle θ) that gradually moves toward the back surface side as the locking portion 15*b* and the locking protrusion 14 go rearward, and the resilient locking piece 15 is configured to elastically deform in an unlocking direction when a moving force of moving the cable holding case 11 to the rear surface side is applied.

Additionally, as illustrated in FIGS. 5 and 6A to 6C, the cable holding case 11 is provided with a rectangular opening 17*a* that opens to the front surface side, as illustrated in FIG. 4, the handle base 8 is provided with an elastic deformation leg 16 protruding toward the back surface side, and as illustrated in FIG. 2, the elastic deformation leg 16 abuts on a peripheral wall of the rectangular opening (an interference protrusion 17) in a state in which the cable holding case 11 is connected to the handle base 8.

As a result, forward movement of the cable holding case 11 is restricted by the elastic deformation resistance of the elastic deformation leg 16 in addition to the elastic deformation resistance of the resilient locking piece 15.

When a large forward force is applied to the cable fixing portion 9 of the cable holding case 11 under the above configuration, as illustrated in FIG. 9B, the elastic deformation leg 16 abutting on the interference protrusion 17 of the handle base 8 elastically deforms, and the cable holding case 11 moves slightly forward. As the cable holding case 11 moves forward, the riding portion 13 of the cable holding case 11 rides over the wall surface of a recessed portion of the handle base 8 (the riding protrusion 12), the cable holding case 11 rotates clockwise in FIG. 9B around the locking portion of the front end portion with the handle base 8, and the resilient locking piece 15 moves to the back surface side.

By the movement of the resilient locking piece 15 toward the back surface side, the locking portion 15*b* of the resilient locking piece 15 moves in the unlocking direction so as to slide down along the locking surface of the locking protrusion 14, and when a forward moving force is further applied, as illustrated in FIG. 9C, the locking of the resilient locking piece 15 with the locking protrusion 14 is completely released, and the cable holding case 11 is completely detached from the handle base 8 by an additional load.

Therefore, in this example, when a distance between the door latch device 4 fixed to the door panel and the inside handle device fixed to the door trim becomes larger than a distance in an initial state due to a collision accident of the vehicle and the like, the outer cable 1 of the cable device 3 connecting the door latch device 4 and the inside handle device is pulled, and a load in a pulling direction is applied to the cable fixing portion 9 of the cable holding case 11.

As described above, the cable holding case 11 is detached from the handle base 8 by the load applied to the cable fixing portion 9, and thereafter independently moves as a cable unit. Since a pulling force is not applied to the inner cable 2, a latch release operation force is not applied to the door latch device 4.

This application is based on a Japanese Patent Application (Japanese Patent Application No. 2018-014547) filed on Jan. 31, 2018, the contents of which are incorporated herein by reference.

DESCRIPTION OF REFERENCE NUMERALS AND SIGNS

1 outer cable
2 inner cable
3 cable device
4 door latch device
5 operation portion
6 cable connection recessed portion
7 handle body
8 handle base
9 cable fixing portion
10 handle connecting portion
11 cable holding case
12 riding protrusion
13 riding portion
14 locking protrusion
15 resilient locking piece
16 elastic deformation leg
17 interference protrusion

What is claimed is:

1. An inside handle device of a vehicle comprising:

a handle base; and a cable holding case, wherein the inside handle device is connected to a door latch device fixed to a door via a cable device in which an inner cable is inserted into an outer cable, and is configured to remotely control the door latch device, wherein the handle base is configured to swingably support a handle body, wherein the handle body includes an operation portion capable of being operated from a front surface at one end portion and a cable connection recessed portion opening to a back surface direction at another end portion, wherein the cable holding case includes a cable fixing portion configured to fix one end of the outer cable, wherein the cable holding case is configured to hold a handle connecting portion formed at one end of the inner cable and capable of being connected to the handle base, and configured to lock the handle connecting portion in a connected state to the cable connection recessed portion of the handle body, wherein the cable holding case is capable of releasing the connection with the handle base by generating a connection release force in the back surface direction by changing a direction of a load applied to the cable fixing portion in a pulling direction by the outer cable, and wherein the cable holding case includes a riding portion which rides over a riding protrusion of the handle base and moves the cable holding case in a connection release direction as the cable fixing portion moves in the pulling direction, to change the direction of the load applied to the cable fixing portion in the pulling direction.

2. The inside handle device of a vehicle according to claim 1, wherein the cable holding case is locked to the handle base at a peripheral portion where the cable fixing portion is formed, and wherein an opposite edge portion is resiliently locked to the handle base on a rotation locus with a locking portion with the handle base as a rotation center and is connected to the handle base.

3. The inside handle device of a vehicle according to claim 2, wherein the cable holding case is provided with a hook-shaped resilient locking piece which resiliently locks to a locking protrusion protruding from the handle base, and wherein a locking surface between the locking protrusion and the resilient locking piece is formed by an inclined surface which generates an operation force in an unlocking direction on the elastic locking piece by a load applied to the cable holding case in the connection release direction.

4. The inside handle device of a vehicle according to claim 3, wherein an elastic deformation leg which extends in a direction substantially orthogonal to a cable pulling direction from the cable fixing portion protrudes from one of the cable holding case and the handle base, and wherein the other of the cable holding case and the handle base is provided with an interference protrusion which abuts on a free end portion of the elastic deformation leg and restricts movement of the cable holding case in the cable pulling direction.

* * * * *